US009357809B2

(12) United States Patent
Basson

(10) Patent No.: US 9,357,809 B2
(45) Date of Patent: Jun. 7, 2016

(54) PROTECTIVE HELMET

(75) Inventor: Gilles Basson, Chatillon sur Chalaronne (FR)

(73) Assignee: MSA Production France, Chatillon sur Chalaronne (FR)

( * ) Notice: Subject to any disclaimer, the term of this patent is extended or adjusted under 35 U.S.C. 154(b) by 413 days.

(21) Appl. No.: 13/575,418

(22) PCT Filed: Jan. 26, 2011

(86) PCT No.: PCT/IB2011/000273

§ 371 (c)(1),
(2), (4) Date: Jul. 26, 2012

(87) PCT Pub. No.: WO2011/101721

PCT Pub. Date: Aug. 25, 2011

(65) Prior Publication Data

US 2012/0291184 A1 Nov. 22, 2012

(30) Foreign Application Priority Data

Feb. 19, 2010 (FR) ..... 10 51203

(51) Int. Cl.
*A42B 3/04* (2006.01)
*A63B 71/10* (2006.01)

(52) U.S. Cl.
CPC ..... *A42B 3/0406* (2013.01)

(58) Field of Classification Search
CPC .... A42B 3/0406; A42B 3/0426; A42B 3/042; A42B 3/12; A42B 3/127; A42B 3/125; A42B 3/128; G02B 23/18
USPC ..... 2/410–415, 424, 426, 432, 433, 439, 2/6.2, 6.3, 6.5, 6.6, 15; 358/409; 359/409
See application file for complete search history.

(56) References Cited

U.S. PATENT DOCUMENTS

| | | | | |
|---|---|---|---|---|
| 4,195,328 | A * | 3/1980 | Harris, Jr. | 362/549 |
| 4,741,054 | A * | 5/1988 | Mattes | 2/421 |
| 4,828,378 | A | 5/1989 | Ellis | |
| 5,119,505 | A | 6/1992 | Tisseront et al. | |
| 5,207,500 | A * | 5/1993 | Rios et al. | 362/105 |
| 5,337,420 | A * | 8/1994 | Haysom et al. | 2/410 |
| 5,584,073 | A | 12/1996 | Radzelovage et al. | |
| 7,128,434 | B1 * | 10/2006 | Nally et al. | 362/105 |
| 8,001,623 | B2 * | 8/2011 | Gertsch et al. | 2/422 |
| 2002/0148032 | A1 * | 10/2002 | Basson et al. | 2/422 |
| 2004/0143888 | A1 | 7/2004 | Bataille et al. | |
| 2006/0015979 | A1 * | 1/2006 | Sutter et al. | 2/9 |
| 2006/0174401 | A1 * | 8/2006 | Prendergast | 2/422 |
| 2007/0114252 | A1 | 5/2007 | Gruebel et al. | |
| 2008/0170838 | A1 * | 7/2008 | Teetzel et al. | 386/118 |

FOREIGN PATENT DOCUMENTS

| | | | |
|---|---|---|---|
| EP | 1895865 | A1 | 3/2008 |
| JP | 61288525 | A | 12/1986 |
| WO | 02071879 | A1 | 9/2002 |

* cited by examiner

*Primary Examiner* — Robert J Hicks
*Assistant Examiner* — Timothy K Trieu
(74) *Attorney, Agent, or Firm* — The Webb Law Firm

(57) ABSTRACT

A protective helmet including a rigid shell and an electronic connecting device mounted on the shell, the connecting device including an electronic circuit, first means for connecting said circuit to a power supply system, and second means for connecting said circuit to at least one accessory that can be mounted on the helmet, wherein the connecting device is mounted on the shell in an opening formed in said shell.

18 Claims, 4 Drawing Sheets

PROTECTIVE HELMET

CROSS REFERENCE TO RELATED APPLICATIONS

This application claims priority to French Patent Application No. FR10/51203, filed Feb. 19, 2010, which is incorporated herein by reference in its entirety.

BACKGROUND OF THE INVENTION

1. Field of the Invention

The present invention relates generally to protective helmets and headwear, and in particular to helmets worn by specific personnel in certain environments, including helmets worn by airplane or helicopter flight personnel.

2. Description of Related Art

A helmet typically includes a rigid outer shell having a generally spherical shape, intended to cover the wearer's head, and a facial opening for the wearer's face. Fastened on the inner side of the shell are damping and/or padding elements, which include a cap, generally made of polystyrene, and cushions, normally located at the neck.

Such a helmet is traditionally provided with communication members, in particular a microphone and loudspeakers, which allow the helmet's wearer to communicate with other people, despite the significant background noise. Certain helmets also have an interface for a night vision device fastened on a support (also called a dome) connected to the helmet. The operation of these different accessories requires an electronic connecting device that ensures both electrical power and information transmission.

In connection with known helmets, the electronic connecting device is normally arranged in two ways. A first arrangement consists of mounting the connecting device on the shell, on the inner side thereof, a cavity being formed locally in the cap to allow housing of the device. This configuration is not optimal, as it can make wearing the helmet uncomfortable. Moreover, the presence of this large cavity formed in the cap can create a weak area likely to degrade the protection granted by the helmet.

According to a second arrangement, the connecting device is removably mounted on the outer surface of the shell. It may, for example, be fastened using Velcro®. With this configuration, the connecting device forms a member protruding from the helmet, which can catch on various outside elements. This is particularly bothersome in the application involving a helmet intended for airplane or helicopter personnel, which is intended to be worn in a limited space and includes numerous control members and cable connection that may catch on the connecting device. Moreover, with this configuration, the cables coming out of the connecting device are also positioned outside the helmet, which also leads to the risk of catching and potentially damaging interactions.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

SUMMARY OF THE INVENTION

Generally, the present invention provides a protective helmet that addresses some or all of the aforementioned drawbacks and deficiencies. Preferably, the present invention provides a protective helmet that allows for the attachment of an electronic connecting device that does not substantially diminish the wearer's protection and/or comfort. Preferably, the present invention provides a protective helmet that allows for the attachment of an electronic connecting device that reduces the risk of contacting the electronic connecting device with other outside objects. Preferably, the present invention provides a protective helmet that allows for the attachment of an electronic connecting device that reduces the risk of catching or damaging cables or other components of the electronic connecting device.

In one preferred and non-limiting embodiment, provided is a protective helmet that includes a rigid shell and an electronic connecting device connected on the shell. The connecting device includes: an electronic circuit, first means for connecting said circuit to an electrical power circuit, and second means for connecting said circuit to at least one accessory able to be mounted on the helmet. The connecting device is mounted on the shell in an opening formed in said shell. In one preferred and non-limiting embodiment, said protective helmet comprises a rigid shell and a cap which is fastened under the shell and which forms at least part of the damping and/or padding elements. Furthermore, according to one preferred and non-limiting embodiment, the opening formed in the shell extends through the shell and emerges both at the inner and outer sides of the shell.

Thus, the helmet according to the present invention provides a connecting device that is at least partly integrated into the thickness of the shell. This thereby limits the bulk of portions of this device that protrude towards the inside and outside of the shell. Further, the helmet according to the present invention reduces or eliminates discomfort to the wearer, and considerably reduces the risks of catching parts of the helmet in various outside elements. Moreover, if a cavity is provided in the cap to house part of the connecting device, it will have small dimensions relative to existing designs. The protection granted by the helmet is therefore not degraded by the presence of the connecting device.

The opening is, for example, formed in the back portion of the helmet. This prevents unbalancing the helmet. Further, in one preferred and non-limiting embodiment, the opening is formed in the back portion of the helmet and emerges on the lower edge of said back portion. The presence of such an opening grants the helmet a certain elasticity that makes it possible to have a very enveloping shell without harming the ease of placement of the helmet on the head. Moreover, with this structure, it is possible to insert the connecting device through the lower part of the helmet by moving it upwards to cause it to penetrate the opening. Therefore, the positioning function is quick and simple.

According to another preferred and non-limiting embodiment, the first means for connecting said electronic circuit to an electrical power system includes an input port for a cable connected to a power supply source outside the connecting device, such as the general electrical power source of an aircraft (for example, an airplane or a helicopter).

In another preferred and non-limiting embodiment, the first means for connecting said electronic circuit to a power supply system includes a means for receiving a power source, such as a battery or battery cells. It may, for example, be provided that this receiving means includes a part protruding outwardly from the shell, and has at least one guideway intended to cooperate with a corresponding member formed on a module containing said power source.

The accessory connected to the electronic circuit of the electronic connecting device includes at least one of the following: a night vision device, and one or several communication members such as a microphone, a loudspeaker, a mouth lamp, or any combination thereof. The microphone can be situated at the aural cavities and/or in a respiratory mask.

In a further preferred and non-limiting embodiment, the electronic connecting device includes a housing having a main wall and at least one fastening lug that is connected to the main wall such that, in the mounted position, the shell is sandwiched between the main wall and the fastening lug. According to another preferred and non-limiting embodiment, the main wall of the electronic connecting device is situated on the outer side of the shell, and this main wall is substantially sphere portion-shaped extending the shape of the shell at the opening in which the electronic connecting device is mounted. This further improves the integration of the electronic connecting device in the shell and the limitation of the protruding parts.

In a still further preferred and non-limiting embodiment, the protective helmet includes: a support element of a night vision device and/or a visor, where the support element includes a substantially sphere portion-shaped wall mounted on the shell, on the outside thereof, and above a facial opening formed in the shell; and articulating or hinge means between the support element and the shell, arranged to allow the support element to pivot in relation to the shell around a transverse axis situated in the vicinity of the back edge of the support element, between a lowered use position, in which the wall of the support element covers a portion of the shell, and a raised position.

In this embodiment, the second means for connecting the electronic circuit to at least one accessory can include a cable that extends under the shell, passes through an opening formed in the shell in front of the articulating means of the support element, then extends under the support element up to holes formed in the support element to allow the electrical connection with, for example, a night vision device.

Due to the presence of the articulating or hinge means, which do not require the support element to be completely removed in relation to the shell, accidental pulling or removal of the cables is avoided when the support element is raised to change the visor(s) of the shell. In practice, the cable is fastened under the shell and under the support element, and is protected by a piece, called a cap, fastened under the shell. For example, the cable substantially borders the longitudinal plane of symmetry of the helmet.

DETAILED DESCRIPTION OF THE PREFERRED EMBODIMENTS

Figure 1:
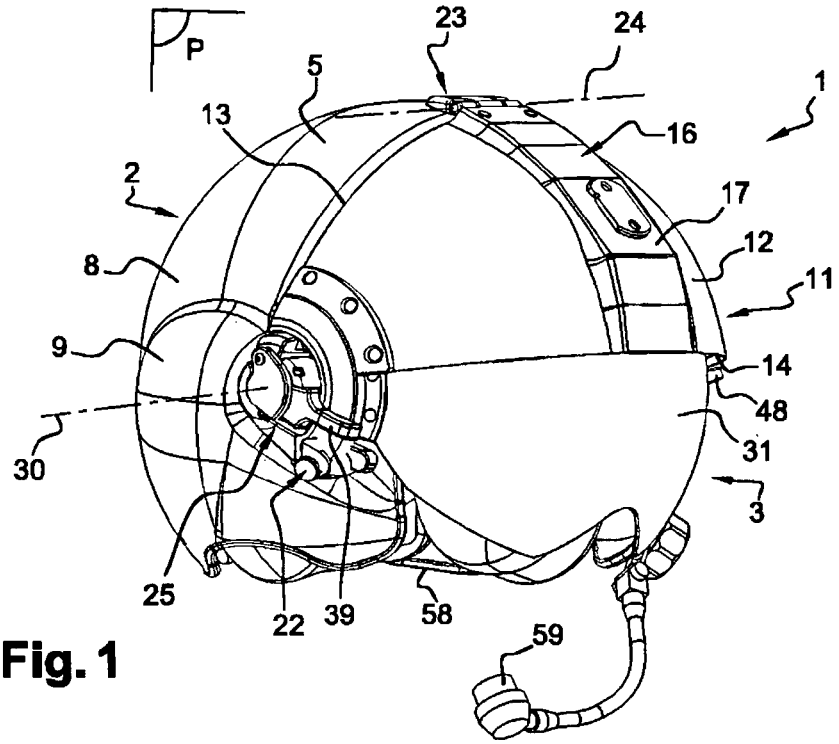
FIG. 1 is a front perspective view of one embodiment of a helmet according to the principles of the present invention, where the helmet is equipped with a communication system and a support element in the lowered position.

For purposes of the description hereinafter, the terms "end", "upper", "lower", "right", "left", "vertical", "horizontal", "top", "bottom", "lateral", "longitudinal" and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

With reference to FIGS. 1-3 and 6-8, provided is a helmet 1, which includes a rigid shell 2 that is intended to fit a wearer's head, and is, for example, made from a composite material. The shell 2 has a longitudinal plane of symmetry P, as illustrated in FIG. 1. For reference, the helmet 1 is described in the position it occupies when it is placed on the wearer's head, as shown in the figures. The transverse direction is defined as the direction orthogonal to the plane P, this direction therefore being horizontal. The term "inner" is used to designate an element closer to the wearer's head, as opposed to the term "outer."

The shell 2 has a generally spherical shape and has a facial opening 3 for the wearer's face. The shell 2 includes: a front portion 4, situated above the facial opening 3, an upper portion 5, a back portion 6 extending from the upper portion 5 to the wearer's neck, as well as a left side portion 7 and a right side portion 8, each extending from the upper portion 5 on either side of the facial opening 3. The side portions 7, 8 can include bulges 9 at the wearer's ears. Moreover, the front portion 4 of the shell 2 is situated withdrawn, towards the inside, in relation to the upper portion 5, thereby forming a step 10 between the front 4 and upper 5 portions.

Figure 3:
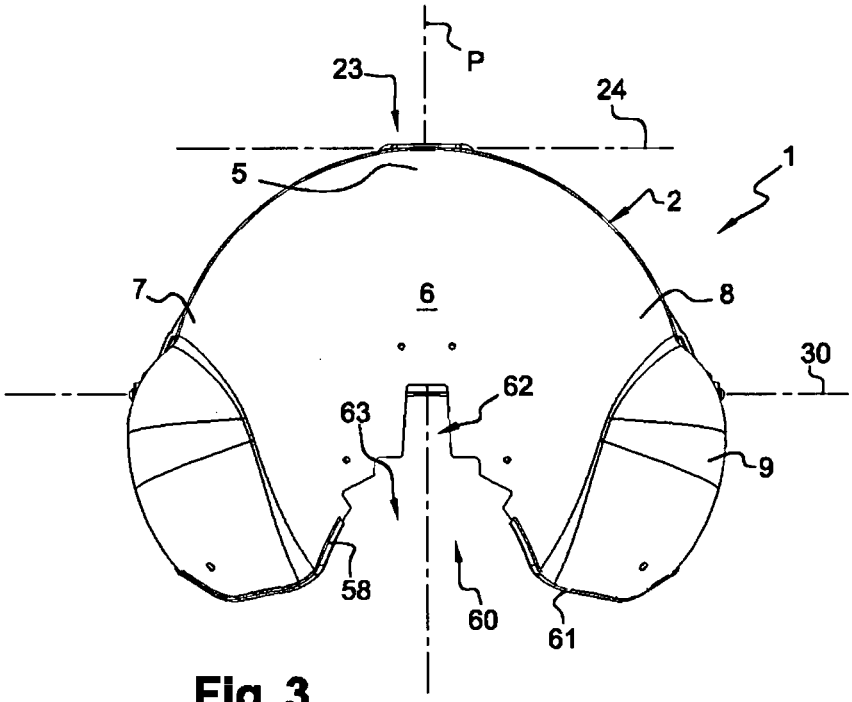
FIG. 3 is a rear view of one embodiment of a shell of the helmet according to the principles of the present invention.

The shell 2 has, in the rear portion 6, an opening 60 that extends from the lower edge 61 of said rear portion 6 over a height close to half the height of the shell 2, as illustrated in FIG. 3. This opening 60 extends through the shell 2 and emerges both at the inner and outer sides of the shell 2. Accordingly, this opening 60 is in the form of a specifically-shaped cut-out portion positioned, for example, at the rear portion 6 of the shell 2.

Still further, in one preferred and non-limiting embodiment, the opening 60 is substantially symmetrical in relation to the plane P. In the illustrated embodiment, it includes a globally rectangular and vertically elongated upper portion 62 extended by a flared lower portion 63 emerging at the lower edge 61. The width of the flared part 63, i.e. its dimension perpendicular to the plane P, is, for example, about one third the length of the shell 2, as shown in FIG. 3.

The helmet 1 also includes a support element 11, also called a dome, that can serve as protection means for the visor(s) and support for a night vision device, among other things. The dome 11 includes a wall 12, which is, for example, made from a composite material. The wall 12 is substantially sphere portion-shaped. It is limited on one hand by a back edge 13 and a front edge 14, both substantially forming a meridian of the sphere portion, and on the other hand by two arcs of circle-shaped side edges 15. The wall 12 has a longitudinal rib 16 including at least one planar face 17 for fastening a night vision device (not shown).

In another preferred and non-limiting embodiment, the dome 11 also includes two side connecting pieces 18 including, on its inner face, an arc of circle-shaped guideway 20 and, on its front end part, a hole 21 in which a screw 22 is non-removably engaged.

The dome 11 is mounted on the shell 2 via articulating means 23, which may be a hinge-type articulating means, positioned in the vicinity of the plane P. The articulating means 23 defines a transverse axis 24 substantially tangent to the upper portion 5 of the shell 2 and situated near the back edge 13, around which the dome 11 can pivot. Thus, the dome 11 can occupy: (1) a lowered use position, in which the dome 11 substantially covers the front portion 4 of the shell 2, on the outer side, between the step 10 and the upper edge of the facial opening 3 (see FIG. 1); and (2) a raised position, in which the dome 11 is spaced away from the front portion 4 of the shell 2, but remains connected to the shell 2 (see FIG. 6). As shown more particularly in FIGS. 1 and 2, when the dome 11 is in the lowered position, it is housed in the recess formed by the front portion 4 of the shell 2 that is withdrawn towards the inside in relation to the upper portion 5. Thus, in this position, the helmet 1 has a globally spherical shape and substantially no excess thickness due to the presence of the dome 11.

The helmet 1 is also provided with two side devices 25 each arranged at a side portion 7, 8 of the shell 2, in front of a bulge 9. Each side device 25 comprises a tapped housing 26 for receiving the screw 22 of the dome 11, to form means for locking the dome 11 in the lowered position. Further, each side device 25 defines a transverse axis 30.

The helmet 1 also comprises a first visor 31 and a second visor 32. The first visor 31 is removably clipped on the side devices 25. While being actuated by a control lever 39, the first visor 31 can pivot, in relation to the shell 2 and around the axis 30, between: (1) a lowered use position, in which the first visor 31 extends in front of the facial opening 3 (see FIG. 1); and (2) a high retracted position, in which the first visor 31 is housed between the front portion 4 of the shell 2 and the wall 12 of the dome 11 (see FIGS. 6 and 8).

The second visor 32 is mounted on the inner side of the dome 11 and can slide in relation thereto. When the dome 11 is in the lowered position, the arc of circle-shaped guideways 20 are centered on the transverse axis 30. While being actuated by a control lever 48, the second visor 32 can pivot, in relation to the shell 2 and around the axis 30, between: (1) a lowered use position, in which the second visor 32 extends in front of the facial opening 3, the second visor 32 being able to be superimposed on the first visor 31 while being situated on the outer side; and (2) a high retracted position, in which the second visor 32 is housed under the wall 12 of the dome 11 (see FIGS. 6 and 8).

Figure 2:
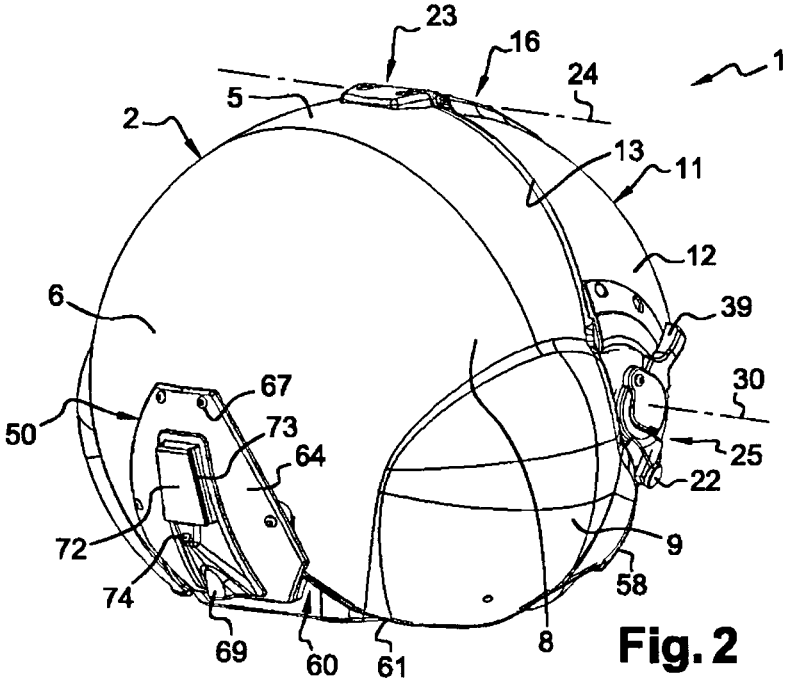
FIG. 2 is a rear perspective view of the helmet of FIG. 1.
Figure 7:
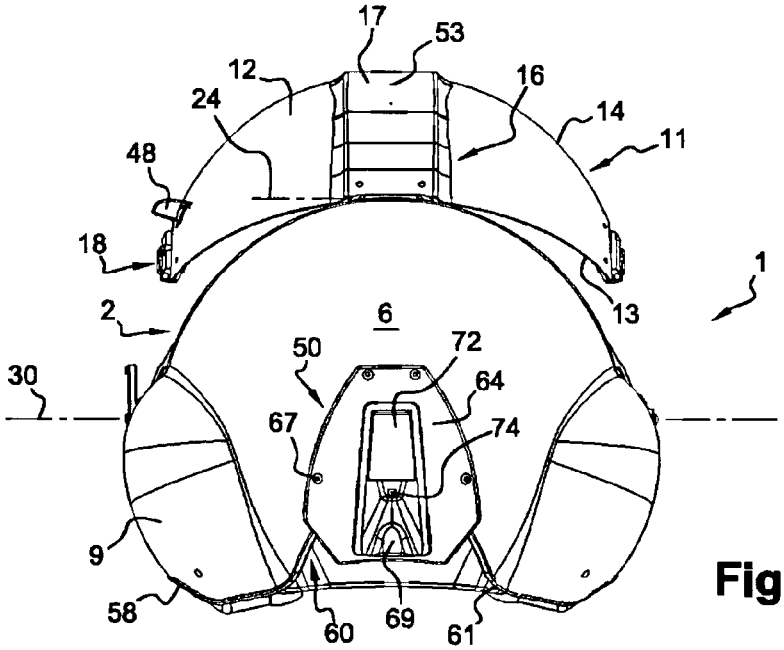
FIG. 7 is a rear view of the helmet of FIG. 6.

As illustrated in FIGS. 2 and 7, the helmet 1 also includes an electronic connecting device 50 mounted on the lower part of the rear portion 6 of the shell 2 and at least partially in the opening 60. The electronic connecting device 50 allows the electrical powering of various accessories equipping the shell 2 and the transmission of information and data to and/or from these accessories. The helmet can, in particular, be equipped with a night vision device fastened on the dome 11, a mouth lamp, and/or communication members, such as a microphone 59 and loudspeakers.

Figure 4:
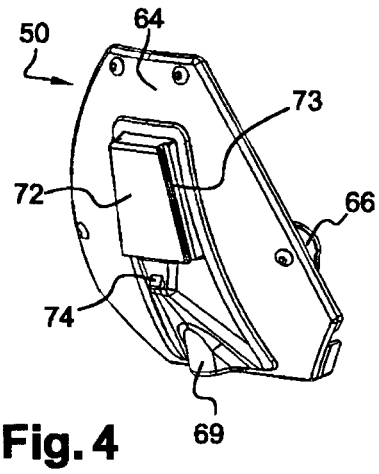
FIG. 4 is an outer side perspective view of one embodiment of an electronic connecting device according to the principles of the present invention.
Figure 5:
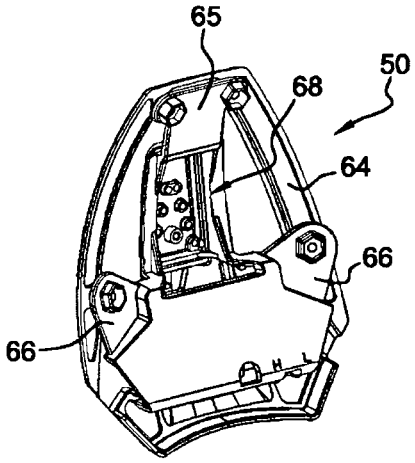
FIG. 5 is an inner side perspective view of the electronic connecting device of FIG. 4.

One preferred and non-limiting embodiment of the electronic connecting device 50 is illustrated in FIGS. 4 and 5. The connecting device 50 includes a housing having a main wall 64 that is substantially in the shape of a sphere portion similar to the shape of the shell 2. Therefore, at least a portion of an outer surface of the main wall 64 is shaped to match the general contour of the shell 2. In this manner, in the mounted position, the main wall 64, which is then situated on the outer side of the shell 2, extends the shape of the shell 2 at the opening 60 in which the electronic connecting device 50 is mounted. Moreover, the housing includes an upper fastening lug 65 and two side fastening lugs 66 protruding from the inner side of the main wall 64 and extending at least partially substantially parallel to the main wall 64.

In this embodiment, the electronic connecting device 50 is introduced into the opening 60 through the bottom and slid upward, such that the shell 2 is sandwiched between the main wall 64 and the fastening lugs 65, 66. The electronic connecting device 50 can then be fastened on the shell 2 using any suitable means, such as by screws 67 situated at the lugs 65, 66. Once placed, the electronic connecting device 50 ensures the continuity with a joint 58 positioned on the lower edge 61 of the shell 2. Because of this, the joint 58 can be interrupted locally at the opening 60, which simplifies its placement.

Figure 8:
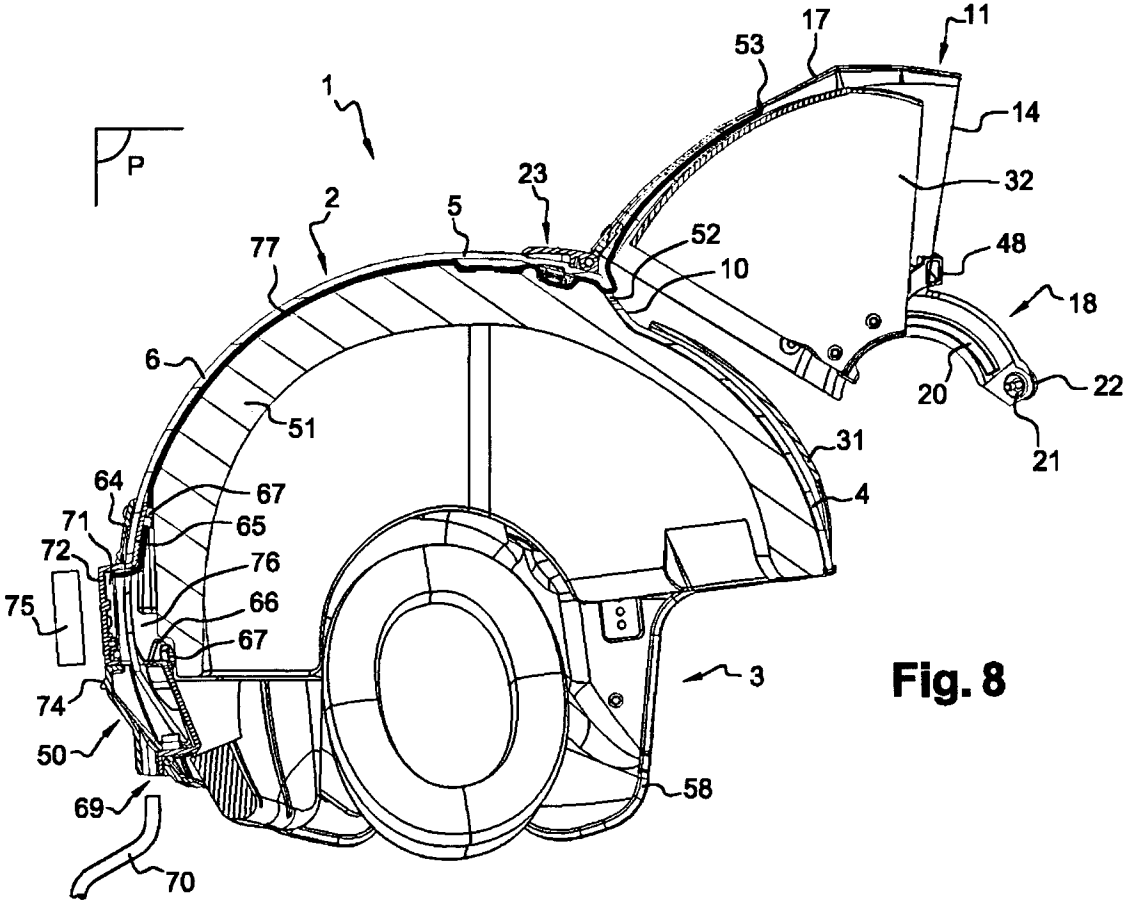
FIG. 8 is a cross-sectional view along the longitudinal plane of symmetry of the helmet of FIG. 6.

The electronic connecting device 50 also includes a housing 68 for receiving an electronic circuit, which is, for example, formed in the main wall 64 and opens toward the inside (see FIG. 5). As illustrated in FIG. 8, the electronic circuit 71 is connected on one hand to a power supply system, and on the other hand to one or several accessories mounted on the helmet 1.

In one preferred and non-limiting embodiment, the power supply system can be formed by the general power source of an aircraft (for example, an airplane or a helicopter). To that end, the electronic connecting device 50 includes an external input port 69, in which a cable 70 can be engaged. Preferably, the internal connecting means are provided so that, once engaged in the port 69, the cable 70 is automatically connected to the electronic circuit 71.

Alternatively or as a complement, the power supply system can be an independent system, such as batteries or battery cells. To that end, the electronic connecting device 50 includes means for receiving a module 75 containing the batteries or battery cells. In the illustrated embodiment, this means includes a part 72 protruding towards the outside of the main wall 64 of the device 50 and having two side guideways 73 allowing placement of the module 75. A stop 74 is also provided for proper positioning of the module 75. Once the module 75 is placed on the part 72, the batteries or battery cells it contains are preferably automatically connected to the electronic circuit 71, for example, by internal connecting means emerging in the guideways 73 and corresponding to contacts provided on the module 75.

As shown in FIG. 8, the electronic connecting device 50 is integrated in the shell 2, at the opening 60, and, based upon the unique design of the opening 60, only slightly protrudes towards the inside and towards the outside of the shell 2. On the inner side, a cavity 76 can be formed if necessary in a cap 51, generally made of polystyrene, which forms at least part of the damping and/or padding elements. However, since the device 50 is at least partially integrated into the thickness of the shell 2, this cavity 76 has smaller dimensions and does not lead to discomfort for the wearer or substantial degradation of the protection granted by the helmet 1.

Figure 6:
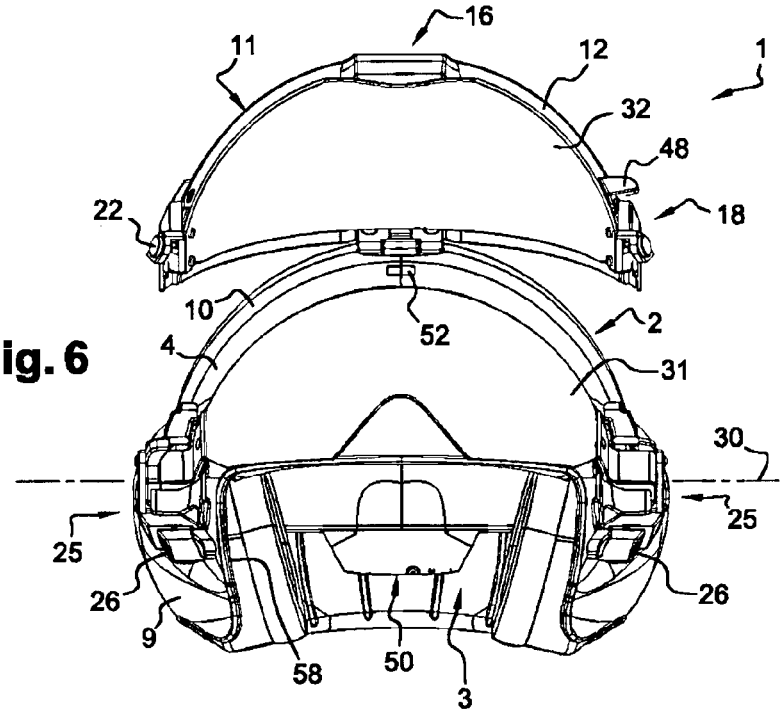
FIG. 6 is a front view of the helmet of FIG. 1, with the support element in the raised position.

The connection between the electronic connecting device 50 and the various accessories equipping the helmet 1 is implemented using cables that, due to the particular positioning of the device 50 according to the invention, are situated inside the helmet 1, and therefore do not risk catching on external elements. In particular, and in one preferred and non-limiting embodiment, the connection between the electronic connecting device 50 and the night vision device is accomplished using a cable 77 that generally assumes the form of an electronic layer. The cable 77 is fastened under the shell 2 substantially along the plane P, while being protected under the cap 51. The cable 77 then passes through an orifice 52 formed in the shell 2 in front of the articulating means 23, substantially at the step 10 (as shown in FIGS. 6 and 8). The cable 77 is then fastened under the dome 11 up to holes 53 formed in the face 17 to enable the electric connection with the night vision device.

The invention provides a number of advantages with respect to known and existing protective helmets. For example, by at least partially integrating the electronic connecting device 50 in the shell 2, a very limited local excess thickness is formed, both towards the inside and the outside, which is advantageous in terms of comfort and practicality. Moreover, integrating the device 50 at the design level of the helmet 1 also allows improved integration of the first means for connection to a power supply system and second means for connection to the helmet's various accessories. Further, the electronic connecting device 50 is designed to be at least partially capable of absorbing energy and/or breaking in the event of impact, so as not to become an element likely to collide with the helmet wearer's head. Since the dome 11 is articulated or hinged, this construction permits access to the two visors to change them independently of each other, and prevents cables from being pulled out when the visor is changed.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. A protective helmet comprising a rigid shell, a cap which is fastened under the shell, and an electronic connecting device mounted on the shell, a portion of the cap defining a cavity extending only partially into a thickness of the cap, the connecting device including an electronic circuit, first means for connecting said circuit to a power supply system, and second means for connecting said circuit to at least one accessory that can be mounted on the helmet, wherein the connecting device is mounted on the shell in an opening formed in said shell, the opening extending through inner and outer sides of said shell, the connecting device at least partly integrated into the thickness of the shell, and wherein the electronic connecting device comprises a housing including a main wall and at least one fastening lug that is connected to the main wall such that when the connecting device is mounted on the shell in the opening formed in said shell, the shell is sandwiched between the main wall and the fastening lug to secure the housing to the shell, and wherein the fastening lug is positioned within the cavity; wherein the opening is formed in a back portion of the shell and emerges at the lower edge of said back portion.

2. The helmet according to claim 1, wherein the first means for connecting said electronic circuit to the power supply system comprises an input port for a cable connected to a power source outside the connecting device.

3. The helmet according to claim 1, wherein the first means for connecting said electronic circuit to the power supply system comprises a means for receiving a power source.

4. The helmet according to claim 3, wherein the receiving means comprises a part protruding outwardly from the shell and has at least one guideway intended to cooperate with a corresponding member formed on a module containing said power source.

5. The helmet according to claim 1, wherein the accessory comprises at least one of a night vision device, a microphone, a loudspeaker, and a mouth lamp.

6. The helmet according to claim 1, wherein the main wall of the electronic connecting device is situated on the outer side of the shell, said main wall being substantially sphere portion-shaped extending the shape of the shell at the opening in which the electronic connecting device is mounted.

7. The helmet according to claim 1, further comprising: a support element of a night vision device and/or a visor, said support element including a substantially sphere portion-shaped wall mounted on the shell, on the outside thereof, and above a facial opening formed in the shell; and an articulated connection between the support element and the shell, said support element pivotable in relation to the shell around a transverse axis situated adjacent a back edge of the support element between a lowered use position, in which said wall of the support element covers a portion of the shell, and a raised position; wherein the second means for connecting the electronic circuit to the at least one accessory includes a cable that extends under the shell, passes through an orifice formed in the shell in front of the articulated connection of the support element, then extends under the support element up to holes formed in the support element to allow the electrical connection with a night vision device.

8. The helmet according to claim 1, wherein the fastening lug is positioned radially inward from the main wall of the housing when the electronic connecting device is mounted on the shell.

9. A protective helmet, comprising: a shell configured for removable placement over a user's head, the shell defining an opening and comprising a front portion, an upper portion, and a back portion, said back portion extending from the upper portion; and an electronic connecting device configured to facilitate electrical communication to at least one accessory associated with the helmet; wherein the electronic connecting device is configured to be at least partially engaged with the opening of the shell, wherein at least a portion of the electronic connecting device comprises an outer surface, at least a portion of which is shaped to match the general contour of the shell, wherein the opening emerges at a lower edge of said back portion extending toward said upper portion and terminating at a position intermediate the lower edge of said back portion and said upper portion; wherein the electronic connecting device comprises a wall and at least one fastening lug, wherein, in the mounted position, at least a portion of the shell is sandwiched between the wall and the at least one fastening lug, and wherein the fastening lug is positioned radially inward from the wall of the housing when the electronic connecting device is mounted on the shell.

10. The protective helmet of claim 9, wherein the opening is in the form of a specifically-shaped cut-out portion positioned at said back portion of the shell.

11. The protective helmet of claim 10, wherein the electronic connecting device is slidably engageable with the opening.

12. The protective helmet of claim 9, wherein the electronic connecting device comprises an electronic circuit in electrical communication with at least one power supply system.

13. The protective helmet of claim 12, wherein the power supply system comprises at least one of the following: at least one input port for a cable connected to a power source, at least one module configured to receive a power source, at least one battery, at least one battery cell, or any combination thereof.

14. The protective helmet of claim 9, further comprising a cap positioned adjacent an inner surface of the shell and configured to provide padding for the user's head, wherein the cap defines a cavity at least partially adjacent the opening of the shell, the cavity configured to receive at least a portion of the electronic connecting device at least partially therein.

15. The protective helmet of claim 9, further comprising a cap positioned adjacent an inner surface of the shell and configured to provide padding for the user's head, wherein at least one cable extends from the electronic connecting device, between the shell and the cap, and out an opening positioned remotely from the electronic connecting device.

16. A protective helmet comprising:

a rigid shell;

a cap which is fastened under the shell;

an electronic connecting device mounted on the shell, the connecting device including an electronic circuit, first means for connecting said circuit to a power supply system, and second means for connecting said circuit to at least one accessory that can be mounted on the helmet, wherein the connecting device is mounted on the shell in an opening formed in said shell, the opening extending through inner and outer sides of said shell, the connecting device at least partly integrated into the thickness of the shell;

a support element of a night vision device and/or a visor, said support element including a substantially sphere portion-shaped wall mounted on the shell, on the outside thereof, and above a facial opening formed in the shell; and an articulated connection between the support element and the shell, said support element pivotable in relation to the shell around a transverse axis situated adjacent a back edge of the support element between a lowered use position, in which said wall of the support element covers a portion of the shell, and a raised position, wherein the second means for connecting the electronic circuit to at least one accessory includes a cable that extends under the shell, passes through an orifice formed in the shell in front of the articulated connection of the support element, then extends under the support element up to holes formed in the support element to allow the electrical connection with a night vision device.

17. The protective helmet of claim 16, wherein the first means for connecting said electronic circuit to a power supply system comprises an input port for a cable connected to a power source outside the connecting device.

18. The protective helmet of claim 16, wherein the first means for connecting said electronic circuit to a power supply system comprises a part protruding outwardly from the shell and has at least one guideway intended to cooperate with a corresponding member formed on a module containing said power source.

* * * * *